US008759262B2

(12) United States Patent
Irving et al.

(10) Patent No.: US 8,759,262 B2
(45) Date of Patent: Jun. 24, 2014

(54) LUBRICATING OIL COMPOSITIONS

(75) Inventors: Matthew D. Irving, Wantage (GB); Stephen Arrowsmith, Didcot (GB)

(73) Assignee: Infineum International Limited (GB)

( * ) Notice: Subject to any disclaimer, the term of this patent is extended or adjusted under 35 U.S.C. 154(b) by 686 days.

(21) Appl. No.: 11/613,206

(22) Filed: Dec. 20, 2006

(65) Prior Publication Data

US 2007/0149419 A1 Jun. 28, 2007

(30) Foreign Application Priority Data

Dec. 28, 2005 (EP) ..... 05113044

(51) Int. Cl.

| | |
|---|---|
| ***C10M 159/20*** | (2006.01) |
| ***C10M 159/22*** | (2006.01) |
| ***C10M 159/24*** | (2006.01) |
| ***C10M 167/00*** | (2006.01) |

(52) U.S. Cl.

CPC ..... *C10M 159/20* (2013.01); *C10M 159/22* (2013.01); *C10M 159/24* (2013.01); *C10M 167/00* (2013.01); *C10M 2207/027* (2013.01); *C10M 2207/028* (2013.01); *C10M 2219/046* (2013.01); *C10M 2219/088* (2013.01); *C10M 2219/089* (2013.01); *C10M 2223/045* (2013.01); *C10N 2210/02* (2013.01); *C10N 2210/06* (2013.01); *C10N 2230/04* (2013.01); *C10N 2230/42* (2013.01); *C10N 2230/43* (2013.01); *C10N 2230/45* (2013.01); *C10N 2240/102* (2013.01)

USPC ..... 508/390; 508/586

(58) Field of Classification Search

USPC ..... 508/390, 584, 586

See application file for complete search history.

(56) References Cited

U.S. PATENT DOCUMENTS

| | | | | |
|---|---|---|---|---|
| 6,281,179 | B1 * | 8/2001 | Skinner et al. | 510/184 |
| 2004/0048753 | A1 * | 3/2004 | Ritchie et al. | 508/232 |
| 2004/0127371 | A1 * | 7/2004 | Arrowsmith et al. | 508/518 |
| 2004/0262237 | A1 * | 12/2004 | Kornbrekke et al. | 210/748 |
| 2005/0043191 | A1 | 2/2005 | Farng et al. | 508/185 |

FOREIGN PATENT DOCUMENTS

| | | | | |
|---|---|---|---|---|
| EP | 1 340 803 | A1 | 9/2003 | C10M 101/02 |
| WO | 2005/061682 | A2 | 7/2005 | C10M 141/06 |

* cited by examiner

*Primary Examiner* — Taiwo Oladapo

(57) ABSTRACT

A lubricating oil composition for internal combustion engines, particularly heavy duty diesel (HDD) engines, having reduced phosphorus, sulfur and sulfated ash contents that provide excellent piston cleanliness performance and contain an amount of phenate detergent that introduces a relatively large amount of phenate soap into the lubricating oil composition.

23 Claims, No Drawings

LUBRICATING OIL COMPOSITIONS

RELATED APPLICATION

This application claims priority from European Patent Application No. 05113044.1, filed Dec. 28, 2005, which is incorporated by reference in its entirety The present invention relates to lubricating oil compositions. More specifically, the present invention is directed to lubricating oil compositions, particularly crankcase lubricants for internal combustion engines, more particularly compression-ignited (diesel) internal combustion engines, especially heavy duty diesel engines, which lubricating oil compositions provide improved compatibility with exhaust gas after-treatment devices and acceptable lubricating oil performance, particularly excellent piston cleanliness performance.

BACKGROUND OF THE INVENTION

Environmental concerns have led to continued efforts to reduce the CO, hydrocarbon and nitrogen oxide ($NO_x$) emissions of compression ignited (diesel-fueled) and spark ignited (gasoline-fueled) light duty internal combustion engines. Further, there have been continued efforts to reduce the particulate emissions of compression ignited internal combustion engines. To meet the upcoming emission standards for heavy duty diesel vehicles, original equipment manufacturers (OEMs) will rely on the use of additional exhaust gas after-treatment devices. Such exhaust gas after-treatment devices may include catalytic converters, which can contain one or more oxidation catalysts, $NO_x$ storage catalysts, and/or $NH_3$ reduction catalysts; and/or a particulate trap.

Oxidation catalysts can become poisoned and rendered less effective by exposure to certain elements/compounds present in engine exhaust gasses, particularly by exposure to phosphorus and phosphorus compounds introduced into the exhaust gas by the degradation of phosphorus-containing lubricating oil additives. Reduction catalysts are sensitive to sulfur and sulfur compounds in the engine exhaust gas introduced by the degradation of both the base oil used to blend the lubricant, and sulfur-containing lubricating oil additives. Particulate traps can become blocked by metallic ash, which is a product of degraded metal-containing lubricating oil additives.

To insure a long service life, lubricating oil additives that exert a minimum negative impact on such after-treatment devices must be identified, and OEM specifications for "new service fill" ad "first fill" heavy duty diesel (HDD) lubricants require maximum sulfur levels of 0.4 mass %; maximum phosphorus levels of 0.12 mass %, and sulfated ash contents below 1.1 mass %, which lubricants are referred to as "mid-SAPS" lubricants (where "SAPS" is an acronym for "Sulfated Ash, Phosphorus, Sulfur"). In the future, OEMs may further restrict these levels maximum levels to 0.08 mass % phosphorus, 0.2 mass % sulfur and 0.8 mass % sulfated ash, with such lubricants being referred to as "low-SAPS" lubricating oil compositions.

As the amounts of phosphorus, sulfur and ash-containing lubricant additives are being reduced to provide mid- and low-SAPS lubricants that are compatible with exhaust gas after-treatment devices, the lubricating oil composition must continue to provide the high levels of lubricant performance, including adequate detergency, dictated by the "new service", and "first fill" specifications of the OEM's, such as the ACEA E6 and MB p228.51 specifications for heavy duty engine lubricants.

United States patent application number US 2005/0043191 discloses a lubricating oil formulation which is free of zinc and phosphorus and comprises at least one borated dispersant, a mixture of metal detergents, an amine antioxidant and a trinuclear molybdenum additive. Provided the composition comprises at least 700 ppm boron and at least 80 ppm molybdenum, acceptable engine performance is achieved.

One of the most effective antioxidant and antiwear agents, from both a performance and cost-effectiveness standpoint, used conventionally in lubricating oil compositions for internal combustion engines comprises dihydrocarbyl dithiophosphate metal salts. The metal may be an alkali or alkaline earth metal, or aluminum, lead, tin, molybdenum, manganese, nickel or copper. Of these, zinc salts of dihydrocarbyl dithiophosphate (ZUDP) are most commonly used. While such compounds are particularly effective antioxidants and antiwear agents and inexpensive, such compounds introduce phosphorus, sulfur and ash into the engine that can shorten the service life of exhaust gas after-treatment devices, as described supra. All metal-containing lubricant additives contribute to the ash content of the lubricant and in addition to ZDDP, a significant amount of lubricant ash is introduced by metal-based detergent additives. Such metal-based detergents include two distinct components, "soap", the function of which is to remove deposits from engine parts, particularly piston deposits; and overbasing, which neutralizes acidic combustion products. Each of the soap and overbasing components of the detergent contribute to the ash content of the detergent.

There are three classes of detergents used conventionally in the formulation of lubricating oil compositions for the lubrication of internal combustion engine crankcases, specifically metal salts of carboxylates (e.g., salicylates), phenates and sulfonates. Carboxylate soap is generally considered to provide superior piston cleaning performance and as superior performance allows for the use of less detergent soap, carboxylate detergents have been favored in the formulation of mid- and low-SAPS lubricating oil compositions. Carboxylates also provide an antioxidancy credit and do not contribute to copper corrosivity. However, carboxylate detergents are available from only a few sources and therefore, supply is constrained. Phenate and sulfonate detergents each have performance debits and credits relative to one another. Phenates, for example, provide a credit in antioxidancy relative sulfonates, but have a deleterious effect on copper corrosivity. Sulfonates provide an antiwear credit relative to phenates, but introduce more sulfur and do not boost antioxidancy. Therefore, when used, phenate and sulfonate detergents are commonly employed in combination. It would be beneficial to be able to provide mid- and low-SAPS lubricating oil compositions formulated with phenate/sulfonate mixtures, which provide acceptable piston cleanliness performance.

The present inventors have identified an anomaly in the performance of phenate detergents. Specifically, while increasing the amount of phenate soap had not been found to have a significant effect on piston cleanliness performance in lubricating oil compositions having conventional ash contents, it has been observed that piston cleanliness performance can be improved dramatically by increasing the level of phenate soap in mid- and low-SAPS lubricating oil compositions therefore allowing formulators to adjust the phenate/sulfonate detergent mixture to provide excellent piston cleanliness performance in mid- and low-SAPS lubricating oil compositions.

SUMMARY OF THE INVENTION

Therefore, in accordance with the invention, there is provided a lubricating oil composition having a phosphorus content of no more than 0.12 mass %, a sulfur content of no more than 0.4 mass % and an ash content, calculated as sulfated ash, of no more than 1.1 mass %, comprising a major amount of oil of lubricating viscosity) a phenate detergent and a sulfonate detergent, wherein the phenate detergent is present in an amount providing the lubricating oil composition with at least 1.4 grams of phenate soap (per 100 grams of lubricating oil composition), and wherein the ratio of the amount of phenate soap to sulfonate soap in mmols per kilogram of lubricating oil composition is preferably at least 5:1.

In accordance with a second aspect of the invention, there is provided a lubricating oil composition, as in the first aspect, having a phosphorus content of less than 0.08 mass %, a sulfur content of less than 0.3 mass % and an ash content, calculated as sulfated ash, of less than 1.0 mass %.

In accordance with a third aspect of the invention, there is provided a method of operating a spark- or compression-ignited internal combustion vehicular engine, particularly a compression-ignited internal combustion vehicular engine, more particularly a heavy duty diesel engine, equipped with an after treatment device containing an oxidation and/or reduction catalyst and/or a particulate trap, which method comprises lubricating said engine with a lubricating oil composition of the first or second aspect.

In accordance with a fourth aspect of the invention, there is provided the use of a lubricating oil composition of the first or second aspect to maintain the piston cleanliness of a spark- or compression-ignited internal combustion vehicular engine, particularly a compression-ignited internal combustion vehicular engine, more particularly a heavy duty diesel engine, provided with at least one exhaust gas treatment device.

Other and further objects, advantages and features of the present invention will be understood by reference to the following specification.

DETAILED DESCRIPTION OF THE INVENTION

The oils of lubricating viscosity useful in the practice of the invention may range in viscosity from light distillate mineral oils to heavy lubricating oils such as gasoline engine oils, mineral lubricating oils and heavy duty diesel oils. Generally, the viscosity of the oil ranges from about 2 $mm^2$/sec (centistokes) to about 40 $mm^2$/sec, especially from about 3 $mm^2$/sec to about 20 $mm^2$/sec, most preferably from about 4 $mm^2$/sec to about 10 $mm^2$/sec as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, di pentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Other examples of base oil are gas-to-liquid ("GTL") base oils, i.e. the base oil may be an oil derived from Fischer-Tropsch-synthesized hydrocarbons made from synthesis gas containing hydrogen and carbon monoxide using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

The oil of lubricating viscosity may comprise a Group I, Group II, Group III oil, or may comprise base oil blends of Group I, Group II, Group III oil and Group IV and/or Group V oil. Preferably, the oil of lubricating viscosity is a Group II, Group III, Group IV or Group V base oil or base oil blend, or a blend of a Group I base oil and one or more of a Group II, Group III, Group IV or Group V base oil. The base oil or base oil blend preferably has a saturate content of at least 65%, more preferably at least 75%, such as at least 85%. Most preferably, the base oil, or base oil blend, has a saturate content of greater than 90%. Preferably, the base oil or base oil blend will have a sulfur content of less than 1 mass %, preferably less than 0.6 mass %, most preferably less than 0.3 mass %. Preferably, the viscosity index (VI) of the base oil or base oil blend is at least 80, preferably at least 90, more preferably from about 120 to 150.

Definitions for the base oil in this invention are the same as those found in the American Petroleum Institute (API) publication "Engine Oil Licensing and Certification System", Industry Services Department, Fourteenth Edition, December 1996. Addendum 1, December 1998. Said publication categorizes base oil as follows:

a) Group I base oils contains less than 90 percent saturates and/or greater than 0.03 mass % sulfur and have a viscosity index greater than or equal to 80 and less than 120 using the test methods specified in Table 1.
b) Group II base oils contains greater than or equal to 90 percent saturates and less than or equal to 0.03 mass % sulfur and have a viscosity index greater than or equal to 80 and less than 120 using the test methods specified in Table 1.
c) Group III base oils contains greater than or equal to 90 percent saturates and less than or equal to 0.03 mass % sulfur and have a viscosity index greater than or equal to 120 using the test methods specified in Table 1.
d) Group IV base oils are polyalphaolefins (PAO).
e) Group V base oil includes all other base oil not included in Group I, II, III, or IV.

Analytical Methods for Base Stock

| Property | Test Method |
|---|---|
| Saturates | ASTM D 2007 |
| Viscosity Index | ASTM D 2270 |
| Sulfur | ASTM D 4294 |

Metal-containing or ash-forming detergents function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound, such as an oxide or hydroxide, with an acidic gas such as carbon dioxide. The resulting overbased detergent comprises neutralized detergent as the outer layer of a metal base (e.g., carbonate) micelle. Such overbased detergents may have a TBN of 150 or greater, and overbased detergents typically used have a TBN from 250 to 450, or more.

Detergents that are conventionally employed include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased metal detergents having TBN of from 20 to 450. Combinations of detergents, whether overbased or neutral or both, may be used.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 wt. % of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Carboxylate detergents, e.g., salicylates, can be prepared by reacting aromatic carboxylic acid with an appropriate metal compound such as an oxide or hydroxide and neutral or overbased products may be obtained by methods well known in the art. The aromatic moiety of the aromatic carboxylic acid can contain heteroatoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges. The carboxylic moiety may be attached directly or indirectly to the aromatic moiety. Preferably the carboxylic acid group is attached directly to a carbon atom on the aromatic moiety, such as a carbon atom on the benzene ring. More preferably, the aromatic moiety also contains a second functional group, such as a hydroxy group or a sulfonate group, which can be attached directly or indirectly to a carbon atom on the aromatic moiety.

The lubricating oil compositions of the present invention comprise combinations of phenate detergents and sulfonate detergents wherein the phenate detergent is present in an amount providing the lubricating oil composition with at least 1.4 crams of phenate soap per 100 grams of lubricating oil composition, such as from about 1.4 to about 2.5 grams of phenate soap per 100 grams of lubricating oil composition, preferably at least 1.5 grams of phenate soap phenate soap per 100 grams of lubricating oil composition, such as from about 1.5 to about 1.8 grams of phenate soap per 100 grams of lubricating oil composition, more preferably at least 1.55 grams of phenate soap per 100 grams of lubricating oil composition, such as from about 1.55 to about 1.75 grams of phenate soap per 100 grams of lubricating oil composition. The ratio of the amount of phenate soap to sulfonate soap (in grams) is at least about 5:1, such as from about 5:1 to 50:1; preferably, at least about 7.5:1, such as from about 7.5:1 to 25:1; more preferably, at least 10:1, such as from about 10:1 to 20:1.

In one embodiment, lubricating oil compositions of the present invention are substantially free from carboxylate detergents (e.g., contain such detergents in an amount providing no more than about 0.5 grams of carboxylate soap per 100 grams of lubricating oil composition), or completely free from carboxylate detergent.

Detergents generally useful in the formulation of lubricating oil compositions also include "hybrid" detergents formed with mixed surfactant systems including phenate and/or sulfonate components, e.g. phenate/salicylates, sulfonate/phenates, sulfonate/salicylates, sulfonates/phenates/salicylates, as described; for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively.

Phenate detergents useful in the practice of the present invention are preferably those having, or having on average, a soap to metal ratio, in terms of grams of soap to grams of metal, of at least 6.0, and are preferably used in a total amount introducing into the composition no more than 0.85 mass % of ash, (expressed as sulfated ash or "SASH", and based on the total weight of the composition), such as 0.4 to 0.85 mass % ash, preferably no more than 0.75 mass % of ash, such as 0.55 to 0.75 mass % of ash, most preferably no more than 0.70 mass % of ash, such as 0.60 to 0.70 mass % of ash. Preferably, the sulfonate detergent is present in an amount introducing into the composition no more than 0.35 mass % of ash, (expressed as sulfated ash or "SASH", and based on the total weight of the composition), such as 0.10 to 0.35 mass % of ash, preferably no more than 0.30 mass % of ash, such as 0.15 to 0.30 mass % of ash, most preferably no more than 0.25 mass % of ash, such as 0.18 to 0.25 mass % of ash, such that the total amount of ash introduced by detergent is preferably no more than 0.95 mass %, such as from about 0.0.5 to about 0.95 mass %, especially no more than 0.90 mass %, such as from about 0.70 to about 0.90 mass % more preferably no more than 0.85 mass %, such as from about 0.75 to about 0.85 mass %. In another preferred embodiment, the phenate detergent is neutral or only slightly overbased and has a total base number of from about 50 to about 150, preferably from about 80 to about 120, more preferably from about 90 to about 115, and the sulfonate provides the majority of the TBN to the lubricating oil composition and has a TBN of from about 150 to about 475, preferably from about 250 to about 425, more preferably from about 300 to about 410. To provide the lubricating oil composition with required level of detergency without exceeding the maximum allowed ash level, detergent(s) may comprise from about 3.0 to about 5.5 mass %, preferably from about 3.5 to about 5.0 mass %, most preferably from about 4.0 to about 4.75 mass % of the lubricating oil composition.

The percentage of surfactant, or soap in an overbased detergent, and thus the soap to metal ratio of a detergent, or mixture of detergents, can be measured by dialysing a known amount (A g, approximately 20 g) of the liquid overbased detergent (substantially free from other lubricating oil additives) through a membrane in a Soxhlet extractor (150 mm height× 75 mm internal diameter) using n-hexane siphoning at a rate of 3 to 4 times per hour for 20 hours. The membrane should be one which retains substantially all the metal-containing material, and passes substantially all the remainder of the sample. An example of a suitable membrane is a gum rubber membrane supplied by Carters Products, Division of Carter Wallace Inc., New York, N.Y. 10105 under the trade name Trojans. The dialysate and residue obtained on completion of the dialysis step are evaporated to dryness, any remaining volatile material then being removed in a vacuum oven (100° C. at less than 1 torr or less than about 130 Pa). The mass of the dried residue, in grams, is designated B. The percentage (C) of overbased detergent material in the liquid sample is given by the equation:

$$C = \frac{B}{A} \times 100\%.$$

Background information for the dialysis technique is given by Amos, R. and Albaugh, E. W. in "Chromatography in Petroleum Analysis", Altgelt, K. H. and Gouw, T. H., Eds, pages 417 to 422, Marcel Dekker, Inc., New York and Basel, 1979.

Phenate and Sulfonate detergents are most commonly calcium-based. In the formulation of mid- and low-SAPS lubricating oil compositions, magnesium salts can be used to replace some or all of the calcium salts. Because magnesium is a lighter metal than calcium, a magnesium-based detergent will introduce less sulfated ash, on a mass % basis, than a like amount of the corresponding calcium-based detergent. Thus, in one preferred embodiment, lubricating oil compositions of the present invention contain a combination of magnesium and calcium detergents, such as a calcium sulfonate detergent and a magnesium phenate detergent; a calcium phenate detergent and a magnesium sulfonate detergent; a calcium sulfonate detergent, a calcium phenate detergent and a magnesium phenate detergent- or a calcium sulfonate detergent, a magnesium sulfonate detergent and a calcium phenate detergent.

Additional additives may be incorporated into the compositions of the invention to enable particular performance requirements to be met. Examples of additives which may be included in the lubricating oil compositions of the present invention are ashless dispersants, supplemental, phosphorus-free antioxidants, metal rust inhibitors, viscosity index improvers, corrosion inhibitors, anti-foaming agents, and pour point depressants. Some are discussed in further detail below.

Dihydrocarbyl dithiophosphate metal salts used as anti-wear and antioxidant agents include those in which the metal is an alkali or alkaline earth metal, or aluminum, lead, tin, molybdenum, manganese, nickel or copper. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The amount of dihydrocarbyl dithiophosphate metal salt used in the lubricating oil composition according to the invention is preferably such that it introduces an amount of phosphorus from about 0.03 to 0.12 mass %, preferably from about 0.04 to 0.10 mass %, and more preferably from about 0.05 to 0.08 mass %.

The preferred zinc dihydrocarbyl dithiophosphates are oil soluble salts of dihydrocarbyl dithiophosphoric acids and may be represented by the following formula:

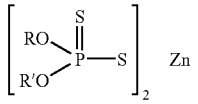

wherein R and P' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate (ZDDP) can therefore comprise zinc dialkyl dithiophosphates. ZDDP is the most commonly used antioxidant/antiwear agent in lubricating oil compositions for internal combustion engines, and in conventional passenger car diesel engines formulated to meet present European ACEA specifications, ZDDP is present in lubricating oil in amounts of from about 1 to about 1.5 mass %, based upon the total weight of the lubricating oil composition. This amount of ZDDP introduces from about 0.1 to about 0.14 mass % of phosphorus into the lubricating oil composition. The phosphorus content of the lubricating oil compositions is determined in accordance with the procedures of ASTM D5185.

Ashless dispersants maintain in suspension oil insolubles resulting from oxidation of the oil during wear or combustion. They are particularly advantageous for preventing the precipitation of sludge and the formation of varnish, particularly in gasoline engines. Ashless dispersants comprise an oil soluble polymeric hydrocarbon backbone bearing one or more functional groups that are capable of associating with particles to be dispersed. Typically, the polymer backbone is functionalized by amine, alcohol, amide, or ester polar moieties, often via a bridging group. The ashless dispersant may be, for example, selected from oil soluble salts, esters, aminoesters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil soluble polymeric hydrocarbon backbone of these dispersants is typically derived from an olefin polymer or polyene, especially polymers comprising a major molar amount (i.e., greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g., polypropylene or polyisobutylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, for example, 1 to 10 mole %, is a non-conjugated diene, such as a $C_3$ to $C_{22}$ non-conjugated diolefin (for example, a copolymer of isobutylene and butadiene, or a copolymer of ethylene, propylene and 1,4-hexadiene or 5-ethylidene-2-norbornene). Preferred are polyisobutenyl (Mn 400-2500, preferably 950-2200) succinimide dispersants. Preferably, heavy duty diesel (HDD) engine lubricating oil compositions of the present invention contain an amount of a nitrogen-containing dispersant introducing from about 0.08 to about 0.25 mass %, preferably from about 0.09 to about 0.18 mass %, more preferably from about 0.10 to about 0.15 mass %, of nitrogen into the composition.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons or esters, phosphorous esters, metal thiocarbamates, oil soluble copper compounds as described in U.S. Pat. No. 4,867,890, and molybdenum-containing compounds.

Phosphorus-free supplemental oxidation inhibitors, other than the previously described hindered phenol antioxidants, suitable for use in the present invention include alkaline earth metal salts of alkylphenolthioesters having preferably $C_5$ to $C_2$ alkyl side chains, calcium nonylphenol sulfide, ashless oil soluble phenates and sulfurized phenates and phosphosulfurized or sulfurized hydrocarbons.

Aromatic amines having at least two aromatic groups attached directly to the nitrogen constitute another class of compounds that is frequently used for antioxidancy. While these materials may be used in small amounts, preferred embodiments of the present invention are free of these compounds. Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups.

Preferably, lubricating oil compositions of the present invention contain hindered phenolic antioxidants, diphenyl amine antioxidants, or a mixture thereof.

The viscosity modifier (VM) functions to impart high and low temperature operability to a lubricating oil. The VM used may have that sole function, or may be multifunctional. Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene. Multifunctional viscosity modifiers that further function as dispersants are also known.

A viscosity index improver-dispersant, also commonly referred to as a multifunctional viscosity modifier, functions as both a viscosity index improver and as a dispersant. Examples of viscosity index improver dispersants include reaction products of amines, for example polyamines, with a hydrocarbyl-substituted mono- or dicarboxylic acid in which the hydrocarbyl substituent comprises a chain of sufficient length to impart viscosity index improving properties to the compounds. In general, the viscosity index improver dispersant may be, for example, a polymer of a $C_4$ to $C_{24}$ unsaturated ester of vinyl alcohol or a $C_3$ to $C_{10}$ unsaturated mono-carboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralised with an amine, hydroxyamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with an amine, hydroxy amine or alcohol.

Pour point depressants, otherwise known as lube oil flow improvers, lower the minimum temperature at which the fluid flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Friction modifiers and fuel economy agents that are compatible with the other ingredients of the final oil may also be included. Examples of such materials include glyceryl monoesters of higher fatty acids, for example, glyceryl monooleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. As an example of such oil soluble organo-molybdenum compounds, there may be mentioned the dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitro-en compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification. No. 1,560,830. Benzotriaoles derivatives also fall within this class of additives. When these compounds are included in the lubricating composition, they are preferably present in an amount not exceeding 0.2 mass % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Foam control can be provided by many compounds including an antifoamant of the polysiloxane type, for example, silicone oil or polydimethyl siloxane.

In the present invention it may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

It is not unusual to add an additive to a lubricating oil, or additive concentrate, in a diluent, such that only a portion of the added weight represents an active ingredient (A.I.). For example, dispersant may be added together with an equal weight of diluent in which case the "additive" is 50% A.I. dispersant. On the other hand, detergents are conventionally formed in diluent to provide a specified TBN and are oftentimes not referred to on an A.I. basis. As used herein, the term mass percent (mass %), when applied to a detergent refers to the total amount of detergent and diluent unless otherwise indicated, and when applied to all other additive refers to the weight of active ingredient unless otherwise indicated.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature. When lubricating compositions contain one or more of the above-mentioned additives, each additive is typically blended into the base oil in an amount that enables the additive to provide its desired function. Representative amounts of such additives, used in crankcase lubricants, are listed below. All the values listed are stated as mass percent active ingredient.

| ADDITIVE | MASS % (Broad) | MASS % (Preferred) |
|---|---|---|
| Corrosion Inhibitor | 0–5 | 0–1.5 |
| Metal Dihydrocarbyl Dithiophosphate | 0.1–6 | 0.1–4 |
| Antioxidant | 0–5 | 0.01–3 |
| Pour Point Depressant | 0.01–5 | 0.01–1.5 |
| Antifoaming Agent | 0–5 | 0.001–0.15 |
| Supplemental Antiwear Agents | 0–1.0 | 0–0.5 |
| Friction Modifier | 0–5 | 0–1.5 |
| Viscosity Modifier | 0.01–10 | 0.25–3 |
| Basestock | Balance | Balance |

Preferably, all the additives except for the viscosity modifier and the pour point depressant are blended into a concentrate or additive package described herein as the additive package that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 25 mass %, preferably 4 to 20 mass %, and most preferably about 5 to 18 mass % of the concentrate additive package with the remainder being base stock. Preferably the volatility of the final crankcase lubricating oil formulation, as measured by the Noack volatility test (ASTM D15880), is less than or equal to 15 mass %, preferably less than or equal to 13 mass %, more preferably less than or equal to 12 mass %, most preferably less than or equal to 10 mass %. Preferably, lubricating oil compositions of the present invention have a compositional TBN (using ASTM D4739) of less than about 10.5, such as between 7.5 and 10.5, preferably less than or equal to about 9.5, such as about 8.0 to about 9.5.

The lubricating oil composition according to the invention is preferably capable of providing at least 40, more preferably at least 42, piston cleanliness merits in an OM441LA test. In addition the oil composition is preferably a heavy duty diesel (FMD) engine lubricant meeting the performance requirements of at least one of, preferably each of, the ACEA E4/E6 and MB p228.5/p228.51 specifications.

This invention will be further understood by reference to the following illustrative examples, wherein all percentages are by weight of active ingredient, unless otherwise noted, and which include preferred embodiments of the invention.

EXAMPLES

Using an additive package containing dispersant, detergent, ZDDP, antioxidant, a molybdenum-based additive and antifoamant, viscosity index improver and lubricating oil flow improver, a series of lubricating oil compositions representing conventional SAPS lubricating oil compositions were prepared. As detergent, combinations of 300 BN calcium sulfonate, 400 BN magnesium sulfonate and 150 BN sulfurized calcium phenate detergents were employed. By adjusting the detergent blend, low soap content (Comparative 1) and high-soap content (Comparative 2) lubricant samples were formulated. A "very-high" soap conventional SAPS lubricating oil composition (Comparative 3) was produced by formulating with a similar additive composition in which the 300 BN calcium sulfonate described above was used in combination with a 135 BN sulfurized calcium phenate, and an amount of nonyl phenol sulfide; an ashless source of phenate soap.

These formulated lubricants were then subjected to an industry standard OM441LA test, passage of which is required by each of the ACEA E4/E6 and MB p228.5/p228.51 specifications. Passage of the OM441 LA test requires, inter alia, 40 merits in piston cleanliness, and, in the future, a replacement test (the OM501LA test) may require even better performance.

The compositions of these conventional SAPS lubricants are summarized, and the piston cleanliness test results obtained are shown, in Table 1.

TABLE 1

| Example Type | Comparative 1 Low-Soap-Content Conventional SAPS | Comparative 2 Med. Soap-Content Conventional SAPS | Comparative 3 High Soap-Content Conventional SAPS |
|---|---|---|---|
| Mass % Phosphorus | 0.12 | 0.12 | 0.09 |
| Mass % Sulfur | 0.33 | 0.39 | 0.38 |
| Mass % SASH | 1.2 | 1.45 | 1.9 |
| Mass % Phenate Soap | 0.55 | 1.36 | 2.25 |
| Mass % Sulfonate Soap | 0.50 | 0.50 | 0.70 |
| Mass % Total Soap | 1.05 | 1.82 | 2.95 |
| TBN (ASTM D4739) | 8.5 | 11.0 | 14.4 |
| Piston Cleanliness Merits | 38.0 | 38.0 | 34.7 |

The data of Table 1 demonstrate that for conventional SAPS lubricants using this detergent mixture, passage of the OM441LA test is difficult regardless of the amount of total soap present in the composition. It is for this reason that carboxylate detergent-based lubricants have been preferred. As is also shown, in conventional SAPS lubricants, increasing the amount of phenate soap did not improve piston cleanliness performance. To the contrary, inferior piston cleanliness performance was shown with Comparative 3, which contained the highest level of phenate soap, and the highest total soap content.

Using an additive package containing the same components as described above, a series of "mid-SAPS" lubricants were formulated. By adjusting the mixture of detergents, lows (Comparative 4 and Comparative 5) and high soap-(Inventive 1) content lubricants were formed. The resulting formulated lubricants were subjected to the OM441LA test, as described above. The compositions of these mid-SAPS lubricants are summarized, and the piston cleanliness test results obtained are shown, in Table 2.

TABLE 2

| Example Type | Comparative 4 Low-Soap-Content Mid-SAPS | Comparative 5 Low Soap-Content Mid-SAPS | Inventive 1 High Soap-Content Mid-SAPS |
|---|---|---|---|
| Mass % Phosphorus | 0.12 | 0.12 | 0.08 |
| Mass % Sulfur | 0.32 | 0.32 | 0.33 |
| Mass % SASH | 1.0 | 1.0 | 1.0 |
| Mass % Phenate Soap | 0.45 | 0.45 | 1.55 |
| Mass % Sulfonate Soap | 0.43 | 0.38 | 0.14 |
| Mass % Total Soap | 0.88 | 0.83 | 1.69 |
| TBN (ASTM D4739) | 8.2 | 8.7 | 8.3 |
| Piston Cleanliness Merits | 33.1 | 35.0 | 45.7 |

As shown, in mid-SAPS lubricants, increasing the amount of phenate soap dramatically improved piston cleanliness performance, which is surprising in that, as demonstrated above, increasing phenate soap content actually results in reduced piston cleanliness performance. The observance of this previously unrecognized phenomenon allows for the formulation of phenate/sulfonate detergent-based mid- and low-SAPS lubricating oil compositions capable of passing the OM441LA test and meeting the requirements of the ACEA E4/E6 and/or MB p228.5/p228.51 specifications. It is also seen that it is extremely difficult to provide a piston cleanliness score of greater than 42 to 43 merits in this test, and that the present formulations, therefore, perform extremely well, in general.

Compositions described as "comprising" a plurality of defined components are to be construed as including compositions formed by admixing the defined plurality of defined components. The principles, preferred embodiments and modes of operation of the present invention have been described in the foregoing specification.

The invention claimed is:

1. A lubricating oil composition comprising:

(a) a major amount of oil of lubricating viscosity;

(b) at least one phenate detergent having, or having on average, a TBN of from about 50 to about 150 mg KOH/g, in an amount providing at least 1.4 grams of phenate soap per 100 grams of lubricating oil composition; and (c) at least one sulfonate detergent having, or having on average, a TBN of from about 150 to about 475 mg KOH/g;

wherein the ratio of the amount of phenate soap, in grams of phenate soap per kilogram of lubricating oil, to the amount of sulfonate soap, in grams of sulfonate soap per kilogram of lubricating oil composition, is from about 5:1 to about 20:1; and wherein the lubricating oil composition has a sulfur content of no more than 0.4 mass %, a phosphorus content of from about 0.03 mass % to no more than 0.12 mass % and an ash content of no more than 1.1 mass % and contains no more than 0.5 grams of carboxylate soap per 100 grams of lubricating oil composition.

2. A lubricating oil composition of claim 1, wherein said at least one phenate detergent is present in an amount providing at least 1.5 grams of phenate soap per 100 grams of lubricating oil composition.

3. A lubricating oil composition of claim 2, wherein said at least one phenate detergent is present in an amount providing at least 1.55 grams of phenate soap per 100 grams of lubricating oil composition.

4. A lubricating oil composition of claim 1, wherein said ratio is at least 7.5:1.

5. A lubricating oil composition of claim 4, wherein said ratio is at least 10:1.

6. A lubricating oil composition of claim 1, wherein said at least one phenate detergent is present in an amount introducing into the lubricating oil composition no more than 0.85 mass % of sulfated ash (SASH).

7. A lubricating oil composition of claim 6, wherein said at least one phenate detergent is present in an amount introducing into the lubricating oil composition no more than 0.75 mass % of sulfated ash (SASH).

8. A lubricating oil composition of claim 7, wherein said at least one phenate detergent is present in an amount introducing into the lubricating oil composition no more than 0.70 mass % of sulfated ash (SASH).

9. A lubricating oil composition of claim 1, wherein the total amount of sulfated ash introduced by detergent is no more than 0.95 mass %.

10. A lubricating oil composition of claim 9, wherein the total amount of sulfated ash introduced by detergent is no more than 0.90 mass %.

11. A lubricating oil composition of claim 10, wherein the total amount of sulfated ash introduced by detergent is no more than 0.85 mass %.

12. A lubricating oil composition of claim 1, which is free from carboxylate detergent.

13. A lubricating oil composition of claim 1, containing at least one calcium detergent and at least one magnesium detergent.

14. A lubricating oil composition of claim 1, wherein said at least one phenate detergent has, or have on average, a TBN of from 80 to 120, and said at least one sulfonate detergent has, or have on average, a TBN of from 250 to 425.

15. A lubricating oil composition of claim 14, wherein said at least one phenate detergent has, or have on average, a TBN of from 90 to 115, and said at least one sulfonate detergent has, or have on average, a TBN of from 300 to 410.

16. A method of improving the piston cleanliness performance of a lubricating oil composition having a sulfur content of no more than 0.4 mass %, a phosphorus content of from about 0.03 mass % to no more than 0.12 mass and an ash content of no more than 1.1 mass %, and no more than 0.5 grams of carboxylate soap per 100 grams of lubricating oil composition, which method comprises formulating said lubricating oil composition at least one phenate detergent having, or having on average, a TBN of from about 50 to about 150 mg KOH/g and at least one sulfonate detergent having, or having on average, a TBN of from about 150 to about 475 mg KOH/g, wherein said phenate detergent is used in an amount introducing at least 1.4 grams of phenate soap per 100 grams of lubricating oil composition and wherein the ratio of the amount of phenate soap to the amount of sulfonate soap in grams per kilogram of lubricating oil composition is from about 5:1 to about 20:1.

17. The method of claim 16, wherein said phenate detergent is used in an amount introducing at least 1.5 grams of phenate soap per 100 grams of lubricating oil composition.

18. The method of claim 17, wherein said phenate detergent is used in an amount introducing at least 1.55 grams of phenate soap per 100 grams of lubricating oil composition.

19. A method of improving the piston cleanliness of an internal combustion engine, which method comprises lubricating said engine with a lubricating oil composition of claim 1, and operating said engine.

20. The method of claim 19, wherein said internal combustion engine is a heavy duty diesel (HDD) engine.

21. The method of claim 20, wherein said heavy duty diesel (HDD) engine is provided with at least one exhaust gas treatment device selected from an oxidation catalyst, a NO trap, an $NH_3$ selective catalytic reduction device and a particulate trap.

22. An internal combustion engine lubricated with a lubricating oil composition of claim 1.

23. A heavy duty diesel (HDD) internal combustion engine lubricated with a lubricating oil composition of claim 1.

* * * * *